US006158070A

United States Patent [19]

Bolden et al.

[11] Patent Number: 6,158,070

[45] Date of Patent: Dec. 12, 2000

[54] COVERLET FOR AN AIR BED

[75] Inventors: Michael V. Bolden, Charleston; Daniel A. Denson, Summerville, both of S.C.

[73] Assignee: Hill-Rom, Inc., Batesville, Ind.

[21] Appl. No.: 09/384,922

[22] Filed: Aug. 27, 1999

[51] Int. Cl.[7] ..... A61G 7/057

[52] U.S. Cl. ..... 5/689; 5/939

[58] Field of Search ..... 5/689, 482, 484, 5/496, 498, 939

[56] References Cited

U.S. PATENT DOCUMENTS

| | | | |
|---|---|---|---|
| 3,686,696 | 8/1972 | Lanigan . | |
| 4,481,686 | 11/1984 | Lacoste . | |
| 4,483,029 | 11/1984 | Paul . | |
| 4,637,083 | 1/1987 | Goodwin . | |
| 4,745,647 | 5/1988 | Goodwin . | |
| 4,768,249 | 9/1988 | Goodwin . | |
| 4,768,250 | 9/1988 | Kato . | |
| 4,798,227 | 1/1989 | Goodwin . | |
| 4,835,802 | 6/1989 | Purcey et al. . | |
| 4,838,309 | 6/1989 | Goodwin . | |
| 4,879,777 | 11/1989 | Goodwin . | |
| 4,914,760 | 4/1990 | Hargest et al. . | |
| 4,935,968 | 6/1990 | Hunt et al. . | |
| 4,942,635 | 7/1990 | Hargest et al. . | |
| 4,944,060 | 7/1990 | Peery et al. . | |
| 4,986,738 | 1/1991 | Kawasaki et al. . | |
| 5,074,000 | 12/1991 | Soltani et al. . | |
| 5,165,141 | 11/1992 | Soltani . | |
| 5,243,723 | 9/1993 | Cotner et al. . | |
| 5,272,778 | 12/1993 | Gore | 137/614.11 |
| 5,320,187 | 6/1994 | Pressley et al. | 173/15 |
| 5,394,576 | 3/1995 | Soltani et al. | 5/689 |
| 5,402,542 | 4/1995 | Viard | 5/421 |
| 5,454,399 | 10/1995 | Kazakis et al. | 137/596.16 |
| 5,539,943 | 7/1996 | Romano | 5/689 |
| 5,586,346 | 12/1996 | Stacy et al. | 5/710 |
| 5,623,736 | 4/1997 | Soltani et al. | 5/689 |

FOREIGN PATENT DOCUMENTS

| | | | |
|---|---|---|---|
| 0 332 242 A2 | 9/1989 | European Pat. Off. | 5/689 |
| WO 91/18578 | 12/1991 | WIPO | 5/689 |

*Primary Examiner*—Alexander Grosz
*Attorney, Agent, or Firm*—Barnes & Thornburg

[57] ABSTRACT

A coverlet is disclosed for enclosing an air fluidizable section of a patient support surface. The air fluidizable section includes a diffuser board assembly for supporting a fluidizable medium, a side wall defining a boundary of the air fluidizable section and an air permeable top wall impervious to the fluidizable medium. The coverlet includes a sheet of material impervious to fluids and comprises a top portion configured to overlie the top wall of the air fluidizable section, and a side portion configured to overhang over the side wall of the air fluidizable section. The side portion of the coverlet includes at least one opening therein to permit air flowing through the air fluidizable section to escape.

36 Claims, 1 Drawing Sheet

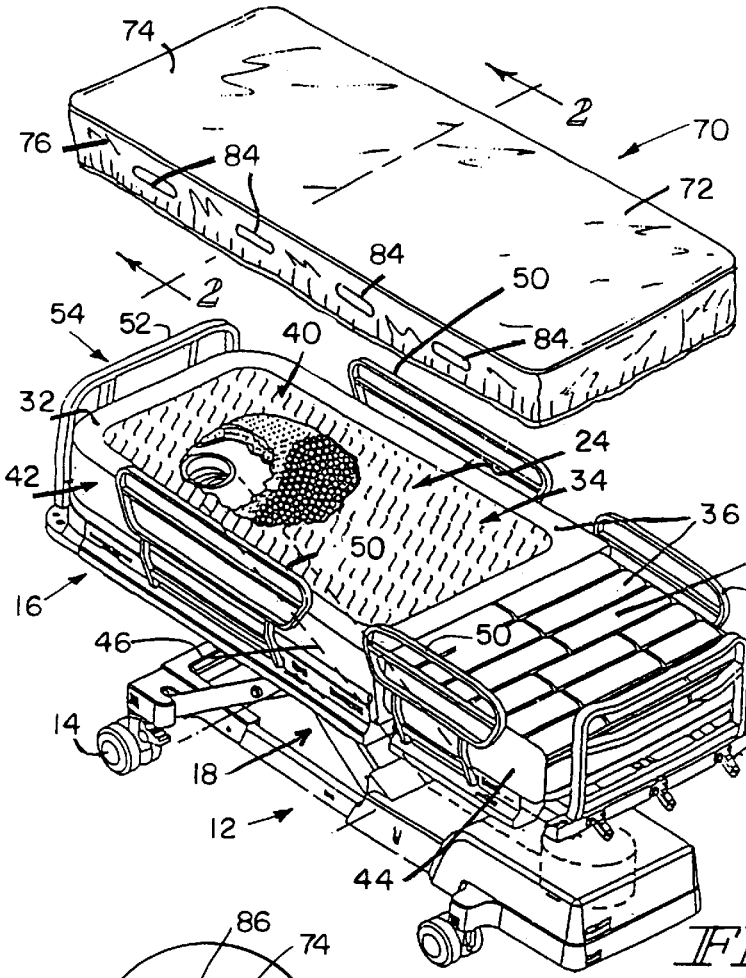
FIG. 1
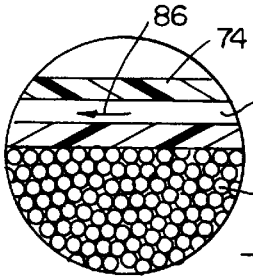
FIG. 2a
FIG. 3
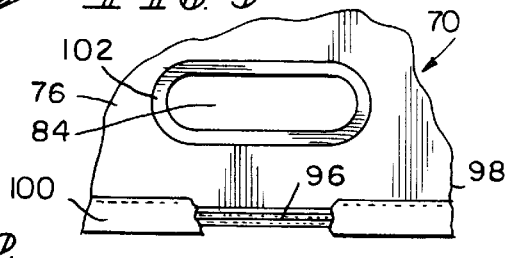
FIG. 2
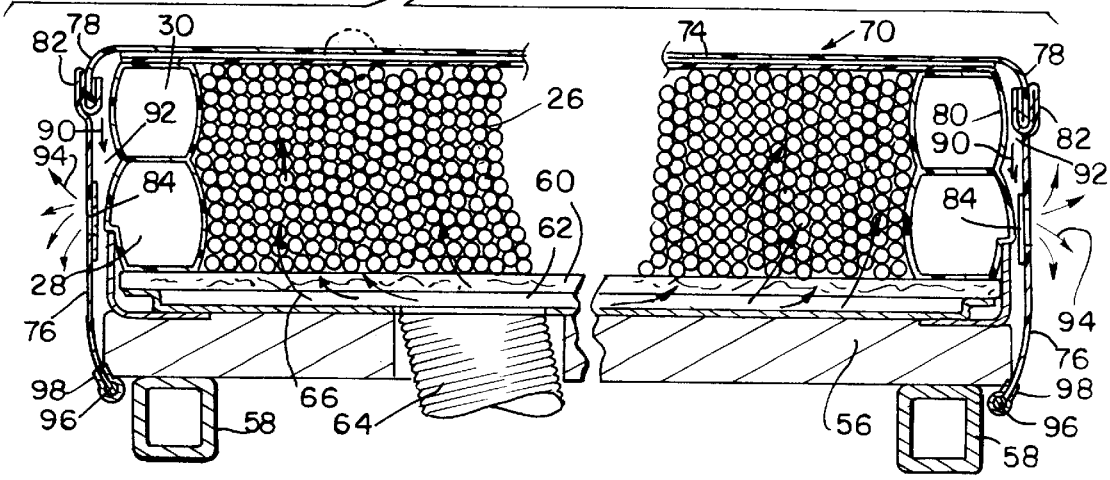

COVERLET FOR AN AIR BED

BACKGROUND AND SUMMARY OF THE INVENTION

The present invention relates to air fluidized support surfaces for beds. More particularly, the present invention relates to an improved coverlet for an air fluidized bed.

Air fluidized beds have been used as patient support systems in homes, hospitals and nursing homes. Air fluidized beds provide an excellent support surface for patients who are at risk of bed sores because they provide relatively uniform distribution of forces on the body. In addition, fluidized beds are well suited for treatment of patients with skin grafts because the fluidized support surfaces do not produce high shear, frictional forces when the patient moves on the bed. In this type of bed, a fluidizable medium such as tiny spheres formed of glass, ceramics, or silicone is contained within a suitable support and fluidized by air passing through the support. In one design, the fluidizable medium is supported by a diffuser board assembly which is permeable to air but impermeable to the fluidizable medium. A retaining mechanism which is impermeable to air is positioned around the outer edges of the diffuser board assembly to contain the fluidizable medium. An air permeable top sheet encloses the fluidizable medium. Typically, the whole assembly is enclosed in a conventional air permeable mattress pad or coverlet. Air flowing upwardly through the fluidizable medium passes through the top sheet and the coverlet, and then escapes to atmosphere. Examples of this type of air fluidized bed are disclosed in U.S. Pat. Nos. 4,481,686, 4,483,029 and 5,623,736 and U.S. patent application, Ser. No. 08/993,183 now U.S. Pat. No. 6,073, 289, all of which are incorporated herein by reference. An example of such beds on the market are Clinitron line of air fluidized therapy units available from Hill-Rom, Inc. (Clinitron is a registered trademark of Hill-Rom, Inc., Batesville, Ind.)

A problem associated with such air fluidized beds is that patient fluids have a tendency to seep through the air permeable coverlet and the top sheet into the tiny beads and the underlying supporting structure. Therefore, the entire bed has to be cleaned and disinfected between successive patients to reduce the risk of cross contamination due to patient fluids. The present invention provides an improved coverlet which is impervious to fluids while allowing the air to escape through a plurality of openings in the side panels of the coverlet. The coverlet can be easily washed and disinfected, avoiding the need for cleaning and disinfecting the entire bed.

According to an illustrated embodiment of the present invention, the coverlet is air and moisture vapor permeable to allow the moisture vapor to escape therethrough. Illustratively, the coverlet material is a fabric coated with a microporous membrane. In another embodiment of the present invention, the coverlet is air and moisture vapor impermeable as well as being fluid impermeable.

Additional features of the present invention will become apparent to those skilled in the art upon consideration of the following detailed description of the illustrated embodiment exemplifying the best mode of carrying out the invention as presently perceived.

BRIEF DESCRIPTION OF THE DRAWINGS

A detailed description particularly refers to the accompanying figures in which:

FIG. 1 is a perspective view of an air fluidized bed which includes air cushions and an air fluidized section located adjacent the air cushions for supporting a patient, and showing a coverlet in accordance with the present invention for enclosing the air cushions and the air fluidized section, the coverlet being impervious to fluids, and having a plurality of openings in the side panels to allow the air flowing through the air fluidized section to escape, FIG. 2 is a sectional view of the bed of FIG. 1 through the air fluidized section, and showing a diffuser board assembly, inflatable ring bladders defining an outer boundary of the air fluidized section, and an air permeable top wall which is impervious to fluidizable medium, FIG. 2*a* is an enlarged view of a portion of the bed of FIGS. 1 and 2, and FIG. 3 is an enlarged view showing a reinforcing backing ring secured to the inside wall of the side panel of the coverlet around an opening therein.

DETAILED DESCRIPTION OF THE DRAWINGS

The present invention will be described primarily as a coverlet for air fluidized bed, but it will be understood that the same may be used in conjunction with any air fluidized patient support surface and low air loss beds.

Referring now to the drawings, FIG. 1 illustrates an air fluidized bed 10 of the present invention which includes a lower frame 12 supported on a plurality of casters 14. An upper frame 16 is coupled to the lower frame 12 by a lifting mechanism 18. The upper frame 16 may include an articulatable head section 20, which can be pivoted upwardly to elevate a patient's head. A plurality of inflatable air cushions 22 are located above the articulatable head section 20 for supporting an upper portion of a patient's body.

The bed 10 also includes a non-articulatable air fluidized section 24 for supporting a lower portion of the patient's body on a fluidizable medium 26. The fluidizable medium 26 typically comprises tiny beads or micro spheres made from glass, ceramics, or silicone. A pair of stacked, inflatable ring bladders 28 and 30, best shown in FIG. 2, form an outer border 32 of the air fluidized section 24. The inflatable ring bladders 28 and 30 are formed from a material which is impermeable to air and the tiny beads 32. The inflatable ring bladders 28 and 30 form a part of a containment system for holding the tiny beads 26 within the air fluidized section 24 of bed 10. The air fluidized section 24 further includes an air permeable top wall 40 to contain the tiny beads 26. The top wall 40 is secured to the inflatable ring bladders 28 and 30 by suitable means.

The air cushions 22 and the air fluidized section 24 cooperate to form a patient support surface 34 of the bed 10. The patient support surface 34 has a top wall 36 formed by top walls 38 and 40 of the air cushions 22 and the air fluidized section 24, respectively. Likewise, the patient support surface 34 has a side wall 42 formed by side walls 44 and 46 of the air cushions 22 and the air fluidized section 24, respectively.

The bed 10 includes a headboard 48, a plurality of collapsible siderails 50, and a footboard 52. A control panel 54 located on the footboard 52 is used to control the air flow to the air cushions 22, the air fluidized section 24, and the inflatable ring bladders 28, 30, as is well known in the art. The control panel 54 also includes a key pad for raising and lowering the head section 20, and for raising and lowering the upper frame 16 of the bed 10 between a low position to facilitate patient ingress and egress, and a high position providing maximum patient access to a caregiver.

As shown in FIG. 2, the upper frame 16 of the bed 10 includes a patient support deck 56 supported on a pair of laterally-spaced, longitudinally-extending support members 58. The patient support deck 56 supports a diffuser board assembly 60 which, in turn, supports the fluidizable medium in the form of tiny beads 26. The air fluidized section 24, thus, includes the diffuser board assembly 60 defining a bottom surface of the air fluidized section 24, the stacked ring bladders 28 and 30 defining the outer boundary 32 of the air fluidized section 24, and the air permeable top wall 40 defining a top surface of the air fluidized section 24. A blower (not shown) and an electronic controller (not shown) are mounted on the lower frame 12. The blower supplies air under pressure to a plenum chamber 62 through a supply line 64. The air moves upwardly in the direction of arrows 66 through the diffuser board assembly 60, and then through the tiny beads 26 to fluidizes the beads 26. The blower additionally supplies pressurized air to the air cushions 22 and the stacked ring bladders 28 and 30. The air pressure in the lower ring bladder 28 is, typically, held at a higher level than the air pressure in the upper ring bladder 30. Relatively low pressure in the upper ring bladder 30 provides a softer surface at the interface with the patient. The electronic controller controls the functioning of the bed 10, including the parameters such as pressure, temperature, etc., in response to the operation of the control panel 54 mounted on the footboard 52.

The diffuser board assembly 60 includes a diffuser board (not shown) which is permeable to air, but impermeable to the tiny beads 26. The diffuser board is sandwiched between first and second perforated metal plates (not shown). The metal plates are formed to include a plurality of tiny apertures therein which cover substantially the entire surface of the metal plates, except solid outer border portions. The inward spacing of the apertures in the metal plates limits the air flow immediately adjacent the stacked ring bladders 28, 30 to provide a more uniform fluidization of the beads 26 as the air moves upwardly in the direction of arrows 66 through the diffuser board assembly 60. Further details of the air fluidized bed 10 of this type are disclosed in the aforementioned U.S. patent application, Ser. No. 08/993,183, entitled "AIR FLUIDIZED BED" now U.S. Pat. No. 6,073,289.

In accordance with the present invention, a coverlet 70 encloses the patient support surface 34 comprising the air cushions 22 and the air fluidized section 24. The coverlet 70 comprises a sheet 72 of material which is impervious to fluids, but permeable to air and moisture vapor. The coverlet 70 includes a top panel 74 configured to overlie the top wall 36 of the patient support surface 34, which, in turn, comprises the top walls 38 and 40 of the air cushions 22 and the air fluidized section 24. Likewise, the coverlet 70 includes a plurality of side panels 76 configured to overhang over the side wall 42 of the patient support surface 34, which, in turn, comprises the side walls 44 and 46 of the air cushions 22 and the air fluidized section 24.

An outer rim portion 78 of the top panel 74 overhangs over the upper portion 80 of the side wall 42 of the patient support surface 34. The side panels 76 are secured along their top edges 82 to the inside surface of the outer rim portion 78 overhanging over the upper portion 80 of the side wall 42. The overhanging outer rim portion 78 of the top panel 74 may be folded over itself, as shown in FIG. 2, and the top edges 82 of the side panels 76 may be sewn to the inside surface of the folded-over portion of the outer rim portion 78. Alternatively, the top edges 82 of the side panels 76 may be secured to the inside surface of the folded-over portion of the outer rim portion 78 by ultrasonic or RF welding. This configuration of the joint between the top panel 74 and the side panels 76 reduces the likelihood of patient fluids seeping through the joint to the inside of the coverlet 70.

The side panels 76 of the coverlet 70 are formed to include a plurality of vents or openings 84 therein to permit air flowing through the air fluidized section 24 to escape to atmosphere. In the illustrated embodiment, the coverlet 70 has four openings 84 on each longitudinal side of the bed 10, and one opening 84 near the footboard 52—i.e., the end of the bed 10 adjacent to the air fluidized section 24. There are no openings in the coverlet 70 adjacent to the headboard 48 of the bed 10 adjoining the air cushions 22. As shown in FIG. 2, the air flows upwardly through the diffuser board assembly 60 in the direction of arrows 66, then through the tiny beads 26, and finally through the top wall 40 of the air fluidized section 24. The air travels sidewardly to the outer edges of the patient support surface 34 in the direction of arrows 86 in the space 88 between the top panel 74 of the coverlet 70 and the top wall 36 of the patient support surface 34, then downwardly in the direction of arrows 90 in the space 92 between the side panels 76 of the coverlet 70 and the side wall 42 of the patient support surface 34, and finally exits to the atmosphere through the plurality of strategically placed openings 84 in the side panels 76 in the direction of arrows 94.

As shown in FIG. 3, an elastic cord 96 in the form of an endless loop is coupled to bottom edges 98 of the side panels 76 of the coverlet 70 to hold the coverlet 70 in place around the patient support surface 34. Preferably, the bottom edges 98 of the side panels 76 of the coverlet 70 may be folded over and sealed along their longitudinal edges to define a channel 100 for enclosing the elastic cord 96 as shown. Each opening 84 may have secured thereto on the inside surface thereof an annular backing ring 102. Any suitable means may be used to secure the annular backing rings 102 to the side panels 76, such as ultrasonic or RF welding, as is well known in the art.

The sheet 72, which is impervious to fluids, is an air and moisture vapor permeable fabric. Illustratively, the fabric is coated with a microporous membrane—such as, breathable urethane. Two examples of coated fabrics are Penn Nyla P061 Dartex fabric and Consoltex Dermoflex soft fabric. Due to the volume of air blowing through the air fluidized section 24, vents 84 are still provided in the illustrated coverlet 70 to permit the air to escape from under the coverlet 70 through the vents 84. In another embodiment of the present invention, the coverlet 70 is air and moisture vapor impermeable as well as being fluid impermeable.

Although the invention has been described in detail with reference to certain illustrative embodiments, variations and modifications exist within the scope and spirit of the present invention as defined in the following claims.

What is claimed is:

1. A coverlet for enclosing an air fluidizable section of a patient support surface, the air fluidizable section having a diffuser assembly for supporting a fluidizable medium, a side wall defining a boundary of the air fluidizable section impervious to the fluidizable medium and an air permeable top wall impervious to the fluidizable medium, the coverlet comprising a sheet of material which is impervious to fluids, the coverlet having a top portion configured to overlie the top wall of the air fluidizable section and a side portion configured to overhang over the side wall of the air fluidizable section, the side portion of the coverlet including at least one opening therein to permit air flowing through the air fluidizable section to escape.

2. The coverlet of claim 1, wherein the coverlet material is air and moisture vapor permeable.

3. The coverlet of claim 1, further comprising an elastic cord in the form of an endless loop coupled to a bottom edge of the side portion of the coverlet to hold the coverlet in place around the air fluidizable section.

4. The coverlet of claim 3, wherein the bottom edge of the side portion of the coverlet is formed to define a channel configured to enclose the elastic cord.

5. The coverlet of claim 1, further comprising an annular backing ring secured to the side portion around the at least one opening.

6. The coverlet of claim 5, wherein the backing ring is secured to the inside surface of the side portion of the coverlet by ultrasonic or RF welding.

7. The coverlet of claim 1, wherein the top portion of the coverlet comprises a top panel configured to overlie the top wall of the air fluidizable section, wherein the side portion of the coverlet comprises a plurality of side panels secured to the top panel along top edges of the side panels and configured to overhang over the side wall of the air fluidizable section, and wherein the side panels are formed to include a plurality of openings therein to permit air flowing through the air fluidizable section to escape.

8. The coverlet of claim 7, further comprising an elastic cord in the form of an endless loop coupled to bottom edges of the side panels of the coverlet to hold the coverlet in place around the air fluidizable section.

9. The coverlet of claim 8, wherein the bottom edges of the side panels of the coverlet are formed to define a channel configured to enclose the elastic cord.

10. The coverlet of claim 9, further comprising annular backing rings secured to the inside surfaces of the side panels around each of the plurality of openings.

11. The coverlet of claim 10, wherein the backing rings are secured to the inside surfaces of the side panels of the coverlet by ultrasonic or RF welding.

12. The coverlet of claim 7, wherein an outer rim portion of the top panel overhangs over the upper portion of the side wall of the air fluidizable section, and wherein the plurality of side panels are secured to the inside surface of the outer rim portion of the top panel overhanging over the upper portion of the side wall.

13. The coverlet of claim 12, wherein the side panels are sewn to the overhanging portion of the outer rim portion of the top panel.

14. The coverlet of claim 12, wherein the side panels are secured to the overhanging portion of the outer rim portion of the top panel by ultrasonic or RF welding.

15. A patient support apparatus comprising:

an air fluidizable section including a diffuser assembly for supporting a fluidizable medium, an air permeable top wall impervious to fluidizable medium and a side wall defining a boundary of the air fluidizable section also impervious to fluidizable medium, and a coverlet for enclosing the air fluidizable section, the coverlet comprising a sheet of material which is impervious to fluids, and having a top portion configured to overlie the top wall of the air fluidizable section and a side portion configured to overhang over the side wall of the air fluidizable section, the side portion of the coverlet including at least one opening therein to permit air flowing through the air fluidizable section to escape.

16. The coverlet of claim 15, wherein the coverlet material is air and moisture vapor permeable.

17. The patient support apparatus of claim 15, further comprising an elastic cord in the form of an endless loop coupled to a bottom edge of the side portion of the coverlet to hold the coverlet in place around the air fluidizable section.

18. The patient support apparatus of claim 17, wherein the bottom edge of the side portion of the coverlet is formed to define a channel configured to enclose the elastic cord.

19. The patient support apparatus of claim 15, further comprising an annular backing ring secured to the side portion of the coverlet around the at least one opening.

20. The patient support apparatus of claim 19, wherein the backing ring is secured to the inside surface of the side portion of the coverlet by ultrasonic or RF welding.

21. The patient support apparatus of claim 15, wherein the top portion of the coverlet comprises a top panel configured to overlie the top wall of the air fluidizable section, wherein the side portion of the coverlet comprises a plurality of side panels secured to the top panel along top edges of the side panels and configured to overhang over the side wall of the air fluidizable section, and wherein the side panels are formed to include a plurality of openings therein to permit air flowing through the air fluidizable section to escape.

22. The patient support apparatus of claim 21, further comprising an elastic cord in the form of an endless loop coupled to bottom edges of the side panels of the coverlet to hold the coverlet in place around the air fluidizable section.

23. The patient support apparatus of claim 22, wherein the bottom edges of the side panels of the coverlet are formed to define a channel configured to enclose the elastic cord.

24. The patient support apparatus of claim 23, further comprising annular backing rings secured the inside surfaces of the side panels around each of the plurality of openings.

25. The patient support apparatus of claim 24, wherein the backing rings are secured to the inside surfaces of the side panels of the coverlet by ultrasonic or RF welding.

26. The patient support apparatus of claim 21, wherein an outer rim portion of the top panel overhangs over the upper portion of the side wall of the air fluidizable section, and wherein the plurality of side panels are secured to the inside surface of the outer rim portion of the top panel overhanging over the upper portion of the side wall.

27. The patient support apparatus of claim 26, wherein the side panels are sewn to the overlapping portion of the outer rim portion of the top panel.

28. The patient support apparatus of claim 26, wherein the side panels are secured to the overlapping portion of the outer rim portion of the top panel by ultrasonic or RF welding.

29. The patient support apparatus of claim 15, wherein the side wall defining a boundary of the air fluidizable section comprises at least one air bladder.

30. The patient support apparatus of claim 15, wherein the fluidizable medium comprises tiny beads made from glass, ceramics, or silicone.

31. A patient support apparatus comprising:

a patient support surface including an inflatable support section for supporting a first portion of a patient's body and an air fluidizable section for supporting a second portion of the patient's body, the air fluidizable section including a diffuser assembly for supporting a fluidizable medium, a side wall defining a boundary of the air fluidizable section also impervious to the fluidizable medium and an air permeable top wall impervious to the fluidizable medium, and a coverlet for enclosing the patient support surface, the coverlet comprising a sheet of material which is impervious to fluids, the coverlet having a top portion configured to overlie the top wall of the patient support surface and a side portion configured to overhang over the side wall of the patient support surface, the side portion of the coverlet including a plurality of openings therein adjacent to the air fluidizable section to permit air flowing through the air fluidizable section to escape.

32. The coverlet of claim 31, wherein the coverlet material is air and moisture vapor permeable.

33. The patient support apparatus of claim 31, wherein the side portion of the coverlet has at least four openings along each of first and second sides of the patient support surface and at least one opening along an end of the patient support surface adjacent to the air fluidizable section.

34. The patient support apparatus of claim 31, wherein the side wall defining a boundary of the air fluidizable section comprises at least one air bladder.

35. The patient support apparatus of claim 31, wherein the fluidizable medium comprises tiny beads made from glass, ceramics, or silicone.

36. The patient support apparatus of claim 31, wherein the inflatable support section comprises a plurality of inflatable air cushions.

* * * * *